US007981360B2

(12) United States Patent
Singh et al.

(10) Patent No.: US 7,981,360 B2
(45) Date of Patent: Jul. 19, 2011

(54) NIOBIUM ADDITION IN CR-MO-¼V STEEL CASTINGS FOR STEAM TURBINE CASING APPLICATIONS

(75) Inventors: Kulvir Singh, Vikasnagar (IN); Jaipal Reddy Gurram, Vikasnagar (IN); Sudhakar Reddy Katam, Vikasnagar (IN); Pashupati Nath, Vikasnagar (IN); Mallesh Pudtha, Vikasnagar (IN); Vishnu Kumar Agrawal, Vikasnagar (IN)

(73) Assignee: Bharat Heavy Electricals Limited (IN)

( * ) Notice: Subject to any disclaimer, the term of this patent is extended or adjusted under 35 U.S.C. 154(b) by 0 days.

(21) Appl. No.: 11/885,810

(22) PCT Filed: Mar. 20, 2006

(86) PCT No.: PCT/IN2006/000097

§ 371 (c)(1),
(2), (4) Date: Sep. 6, 2007

(87) PCT Pub. No.: WO2007/088555

PCT Pub. Date: Aug. 9, 2007

(65) Prior Publication Data

US 2008/0138234 A1 Jun. 12, 2008

(30) Foreign Application Priority Data

Feb. 1, 2006 (IN) ..... 102/KOL/2006

(51) Int. Cl.

| | |
|---|---|
| ***C22C 38/24*** | (2006.01) |
| ***C22C 38/26*** | (2006.01) |
| ***C22C 38/22*** | (2006.01) |

(52) U.S. Cl. ..... 420/110; 420/111; 148/334

(58) Field of Classification Search ..... 148/334; 420/110, 111

See application file for complete search history.

(56) References Cited

U.S. PATENT DOCUMENTS

| | | | | |
|---|---|---|---|---|
| 5,084,238 | A * | 1/1992 | Masuyama et al. | 420/109 |
| 5,855,845 | A | 1/1999 | Beguinot et al. | |

FOREIGN PATENT DOCUMENTS

| | | | |
|---|---|---|---|
| JP | 363199850 | * | 8/1988 |
| JP | 403087332 | A * | 4/1991 |
| JP | 9263888 | | 10/1997 |
| JP | 410259449 | A * | 9/1998 |
| JP | 2003306740 | | 10/2003 |
| JP | 2005029882 | | 2/2005 |

OTHER PUBLICATIONS

Machine-English translation of Japanese patent 410259449, Fujita et al., Sep. 29, 1998.*

* cited by examiner

*Primary Examiner* — Deborah Yee
(74) *Attorney, Agent, or Firm* — The Webb Law Firm

(57) ABSTRACT

A chromium-molybdenum-vanadium (Cr—Mo—V) cast steel including 0.04 to 0.08% by weight of niobium is disclosed. The cast steel may include 0.08 to 0.12% by weight carbon. The cast steel may also have a sulphur content of 0.015% by weight or less, and a phosphorus content of 0.02% by weight or less. The silicon content may be 0.30 to 0.60% by weight, the manganese content may be 0.50 to 0.80% by weight, the chromium content may be 1.20 to 1.50% by weight, the molybdenum content may be 0.90 to 1.10% by weight, and the vanadium content may be 0.20 to 0.30% by weight.

3 Claims, 11 Drawing Sheets

NIOBIUM ADDITION IN CR-MO-¼V STEEL CASTINGS FOR STEAM TURBINE CASING APPLICATIONS

BACKGROUND OF THE INVENTION

This invention relates to steel casting containing Niobium.

This invention further relates to chromium-molybdenum-vanadium (Cr—Mo—V) steel castings containing niobium, for use in steam turbine casing or valve casing applications.

To improve the mechanical properties and weldability of steels, various alloying elements such as Ti, Nb, Mo, W, B etc. have been added to low and high alloy steels. Ti and Nb are added as carbide formers and strengthen the alloy steels by forming fine matrix carbides which interact with dislocations and precipitate at subgrain boundaries thus reducing the secondary creep rate.

Presently, Cr—Mo—V based steel castings are being used for turbine casing and valve casing applications up to around 540° C. Due to increase in power demand and limitation on $CO_2$ emission, there is increasing demand for higher efficiency and output of the steam turbines. It is possible, by increasing the temperature and pressure of the turbine without much increase in cost.

SUMMARY OF THE INVENTION

It is therefore an object of this invention to provide a chromium-molybdenum-vanadium cast steel containing Nb, having greater mechanical strength and ductility at ambient and high temperatures and pressures.

It is a further object of this invention to provide a chromium-molybdenum-vanadium cast steel containing Nb, having greater creep rupture time, rupture elongation and reduction of area under high temperature.

Another object of this invention is to provide a chromium-molybdenum-vanadium cast steel containing Nb, which can be used for manufacturing turbine casings or other components which are subjected to high temperatures and pressures.

In one embodiment of the invention, a chromium-molybdenum-vanadium cast steel containing niobium is provided. More particularly, the invention provides a heat resistant chromium-molybdenum-vanadium steel comprised of 0.08 to 0.12% by weight of carbon, 0.015% by weight or less of sulphur, 0.02% by weight or less of phosphorous, 0.30 to 0.60% by weight of silicon, 0.50 to 0.80% by weight of manganese, 1.20 to 1.50% by weight of chromium, 0.90 to 1.00% by weight of molybdenum, 0.20 to 0.30% by weight of vanadium, the balance being iron apart from incidental impurities, with niobium ranging from 0.04 to 0.08% by weight.

BRIEF DESCRIPTION OF THE DRAWINGS

The invention will now be explained in greater detail with the help of the accompanying drawings.

DESCRIPTION OF THE INVENTION

Figure 1:
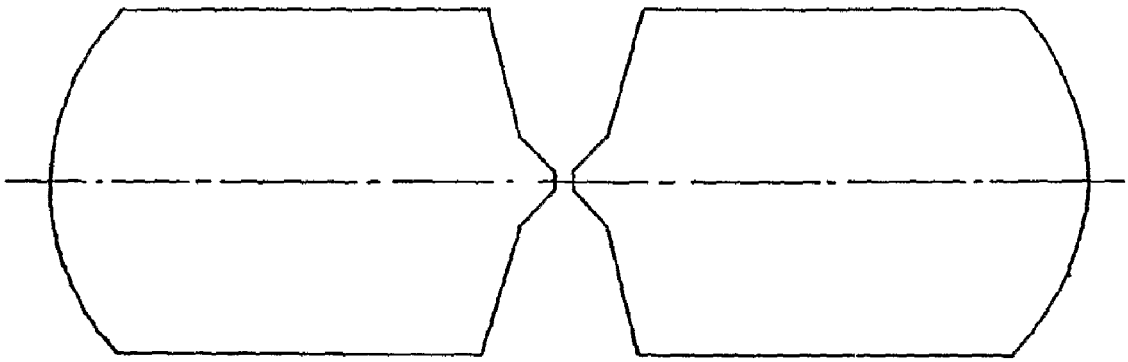
FIG. 1 is a schematic diagram showing the double 'V' edge used for preparation of weld joints.
Figure 2:
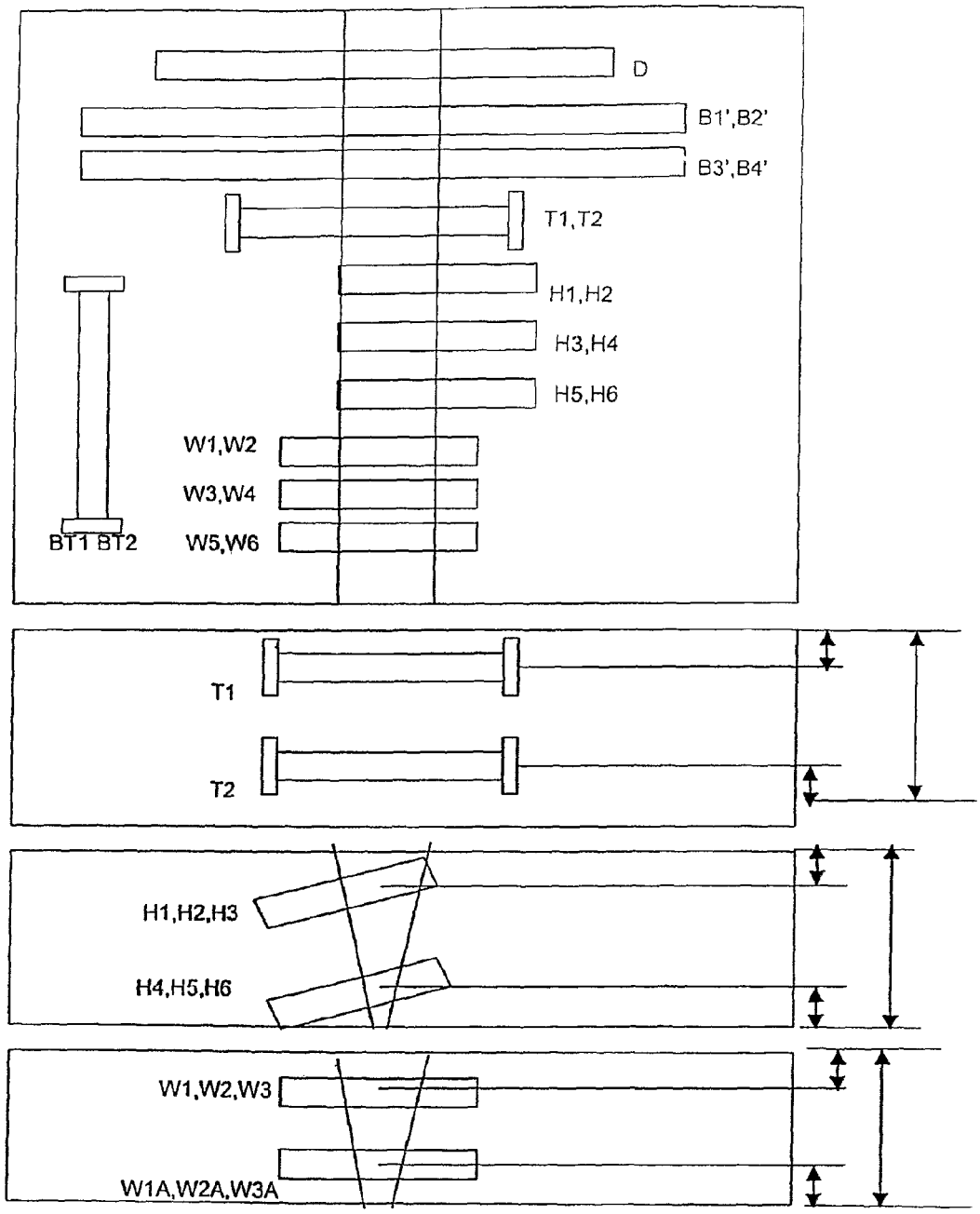
FIG. 2 is a schematic sampling plan for qualification of welding procedures.

According to this invention, a chromium-molybdenum-vanadium (Cr—Mo—V) cast steel containing 0.04 to 0.08% by weight of niobium is provided.

In one embodiment, the cast steel contains 0.08 to 0.12% by weight of carbon, 0.015% by weight or less of sulphur, 0.02% by weight or less of phosphorus, 0.30 to 0.60% by weight of silicon, 0.50 to 0.80% by weight of manganese, 1.20 to 1.50% by weight of chromium, 0.90 to 1.00% by weight of molybdenum, 0.20 to 0.30% by weight of vanadium, the balance being iron apart from incidental impurities with 0.04 to 0.08% by weight niobium being added.

The base chromium-molybdenum-vanadium cast steel is subjected to a homogenizing heat treatment of cast steel, followed by addition of niobium in percentages of 0.04 to 0.08% by weight. The Nb addition is carried out in an induction melting furnace. The resulting casts containing niobium have been subjected to various tests to evaluate their creep/stress rupture, tensile strength.

EXAMPLE

Three casts were obtained by adding Nb in 0.04 to 0.08% by weight to Cr—Mo—V steel. The steel melts were designated as cast cast 'C' and cast 'D' respectively. The base melt without Nb is designated as cast 'A'.

A: Base chromium-molybdenum-vanadium cast (Cr—Mo—V cast)

B: Cr—Mo—V cast with 0.04% by weight niobium.

C: Cr—Mo—V cast with 0.06% by weight niobium.

D: Cr—Mo—V cast with 0.08% by weight niobium.

The heat treatment for cast 'A' was carried out by solutionising base Cr—Mo—V steel by holding for 3 hours at 940° C. followed by forced air cooling. The other casts 'B', 'C' and 'D' were heat treated by solutionising the Cr—Mo—V—Nb steel by holding for 3 hours at 1040° C. followed by forced air cooling. Subsequently all the casts were tempered at 740° C. for 5 hours and cooled up to 300° C. in the furnace and then air cooled to room temperature.

The compositions of all four casts are provided in—Table 1.

TABLE 1

Chemical composition of Cr-Mo-1/4 V castings with different Nb

| Heat No. | C | S | P | Si | Mn | Cr | Mo | V | Nb | Al | Cu | Ni |
|---|---|---|---|---|---|---|---|---|---|---|---|---|
| A | 0.11 | 0.018 | 0.020 | 0.45 | 0.57 | 1.40 | 1.00 | 0.25 | <0.01 | | | 0.050 |
| B | 0.12 | 0.010 | 0.026 | 0.50 | 0.60 | 1.40 | 1.00 | 0.28 | 0.04 | 0.02 | | 0.010 |

TABLE 1-continued

| Chemical composition of Cr-Mo-1/4 V castings with different Nb | | | | | | | | | | | |
|---|---|---|---|---|---|---|---|---|---|---|---|
| C | 0.12 | 0.020 | 0.024 | 0.50 | 0.55 | 1.47 | 0.98 | 0.27 | 0.06 | 0.02 | 0.030 |
| D | 0.12 | 0.010 | 0.012 | 0.53 | 0.51 | 1.70 | 1.03 | 0.24 | 0.08 | | 0.019 |
| Specified | 0.08-0.12 | 0.015 max | 0.02 max | 0.30-0.60 | 0.50-0.80 | 1.20-1.50 | 0.90-1.10 | 0.20-0.30 | | | |
| Permissible Variation | ±0.02 | ±0.003 | ±0.003 | ±0.10 | ±0.07 | ±0.08 | ±0.06 | ±0.03 | | | |

| Heat No | Co | Ti | W | Pb | Sn | As | Bi | Ce | Sb | B |
|---|---|---|---|---|---|---|---|---|---|---|
| A | 0.005 | 0.003 | 0.01 | | <0.001 | <0.001 | | | 0.001 | <0.001 |
| B | <0.001 | <0.001 | 0.01 | | <0.001 | <0.001 | | | <0.001 | <0.001 |
| C | <0.001 | <0.001 | 0.01 | | <0.001 | <0.001 | | | <0.001 | <0.001 |
| D | <0.001 | <0.001 | 0.01 | | <0.001 | <0.001 | | | <0.001 | <0.001 |

Cr—Mo—V electrodes were used for welding. Welding, as per the plant practices detailed out in Table 2, was carried out on the castings to get the adequate number of samples. Weldability studies were conducted. Weldability tests with 180° C. bend test passed on all the four casts.

TABLE 2

| Details of the Welding procedures: | |
|---|---|
| Preheat temperature | 300° C.(Validity: 240° C. Min) |
| Inter-pass Temp. | 400° C. (Validity: 500° C. Max) |
| State of heat treatment | Quenched & Tempered |
| Type of Post weld heat Treatment | Quenching and Tempering |
| Temp. | WQ-930° C.(valid from 930° C. to 950° C.)<br>T-720° C. (valid from 710° C. to 730° C.) |
| Time | WQ-6 Hours T-8 Hours. |
| Current range | 180-220 Amp. DC |
| Voltage range | 24-28 V |
| Polarity | Reverse (valid for DCEP Only) |
| Joint Preparation | Full penetration with backing |
| Location of Weld | Root face 2 mm, Root gap 5 mm, seam side angle 10° |
| Weld sequence | Multilayer Welding |

All the four casts of Cr—Mo—V steel without and with niobium (Nb) addition were subjected to hardness, impact, tensile, hot tensile and creep/stress rupture testing. Creep/stress rupture testing were carried out at 525, 550, 575 and 600° C. and stresses varying from 100-300 MPa. Microstructural analysis including scanning electron microscopy was carried out on the as received as well as creep rupture tested material.

Room and high temperature tensile strength of 1Cr1Mo¼V steel with Nb addition was tested and is higher than plain 1Cr1Mo¼V steel. Among Nb added steels, tensile strength of 0.06% Nb steel was found to be highest.

Figure 3A:
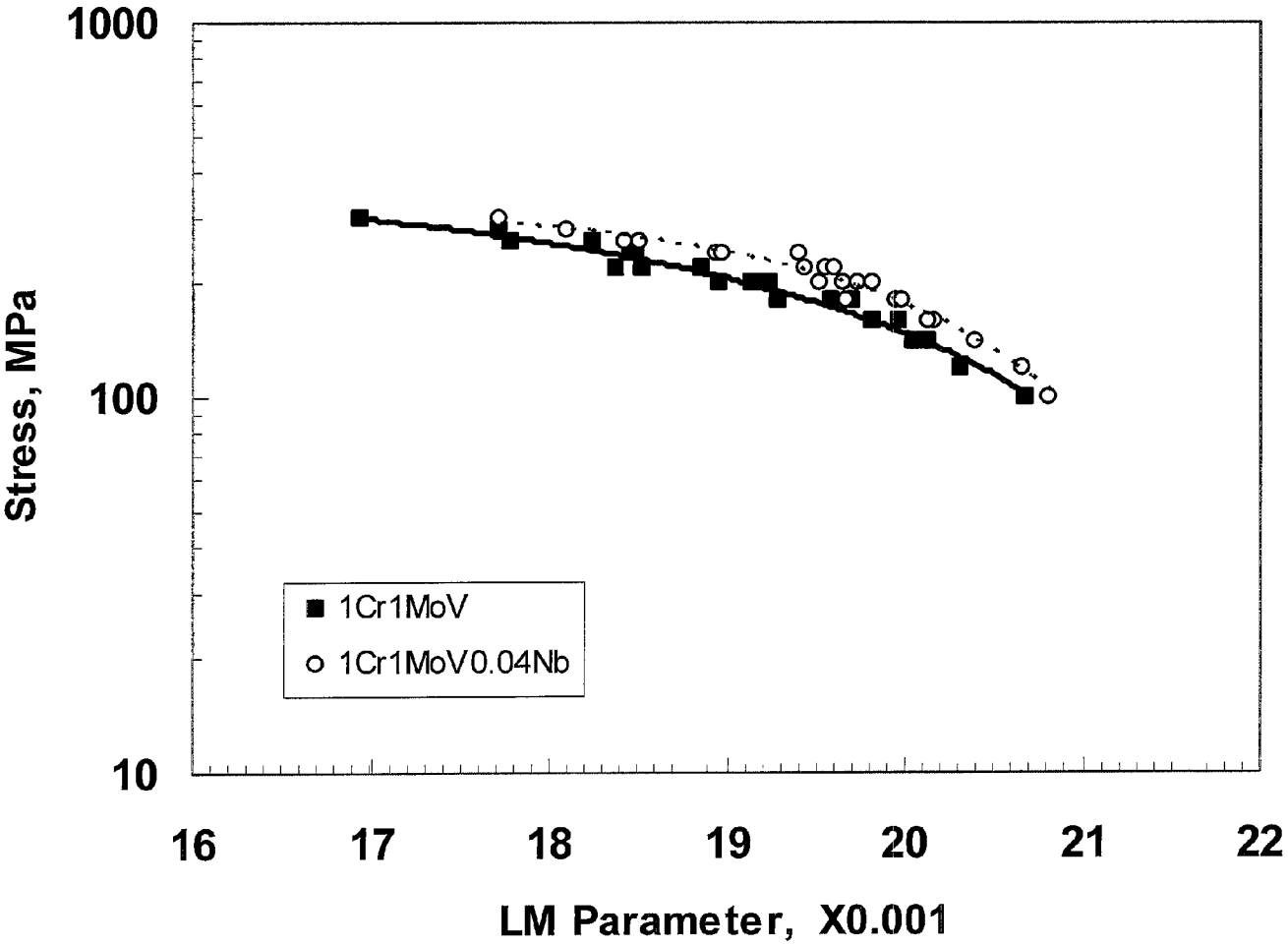
FIGS. 3A-3C are graphical representations of Larson Miller Parameter vs. stress plots for 1Cr1Mo¼V steel with different Nb contents.
Figure 3B:
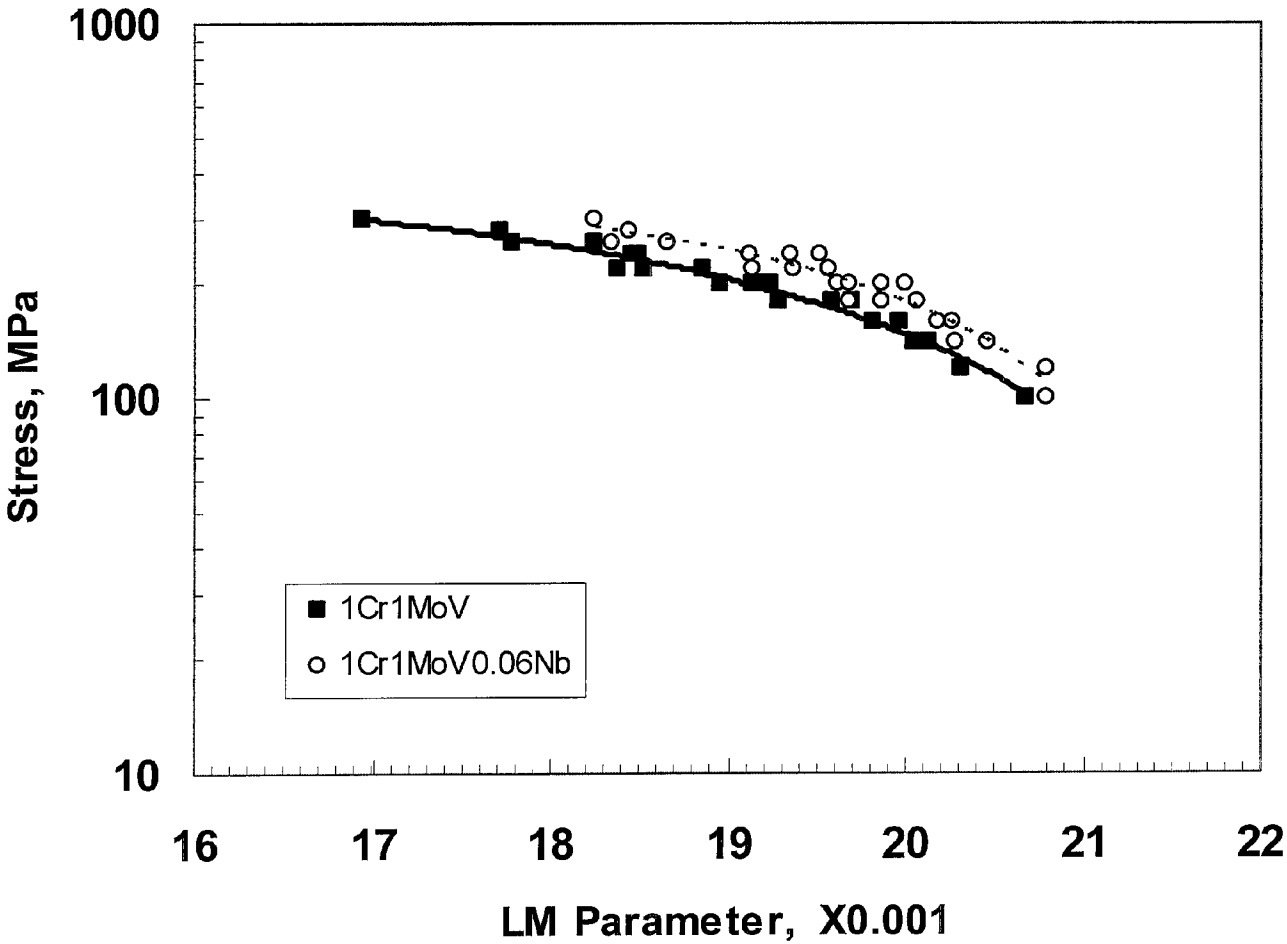
Figure 3C:
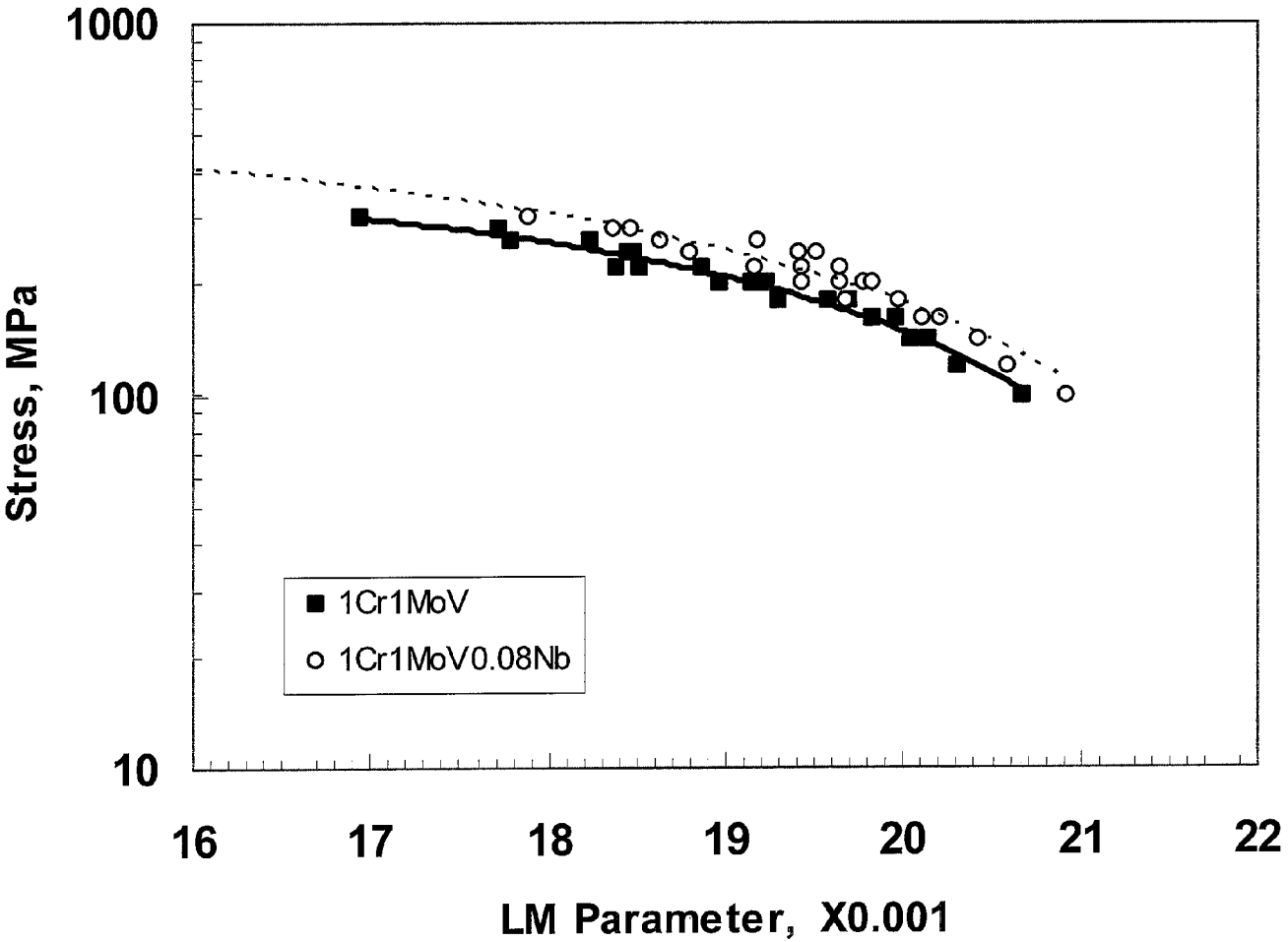
Figure 4A:
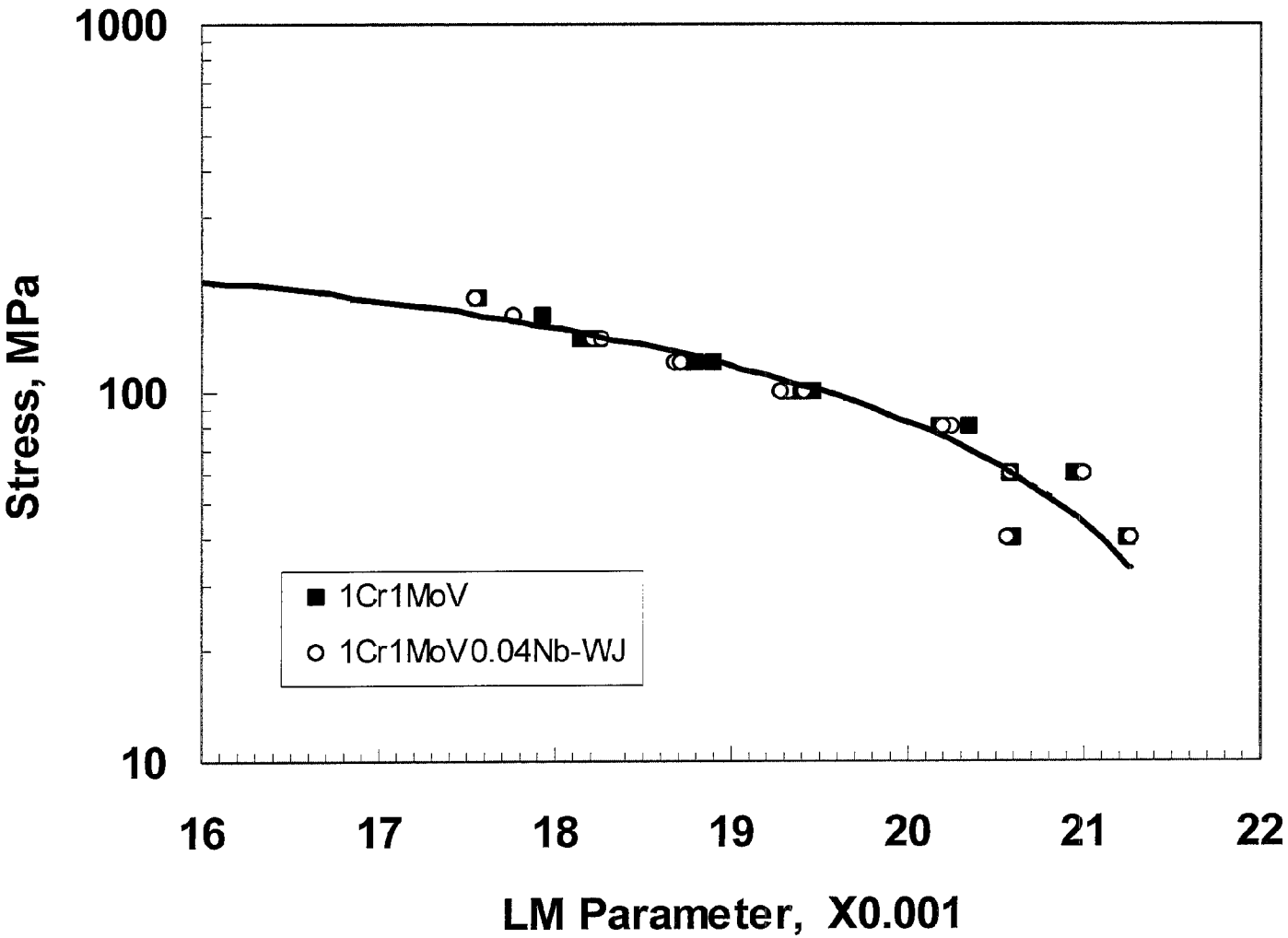
FIGS. 4A-4C are graphical representations of Larson Miller Parameter vs. stress plots for 1Cr1Mo¼V steel weld joints with different Nb contents.
Figure 4B:
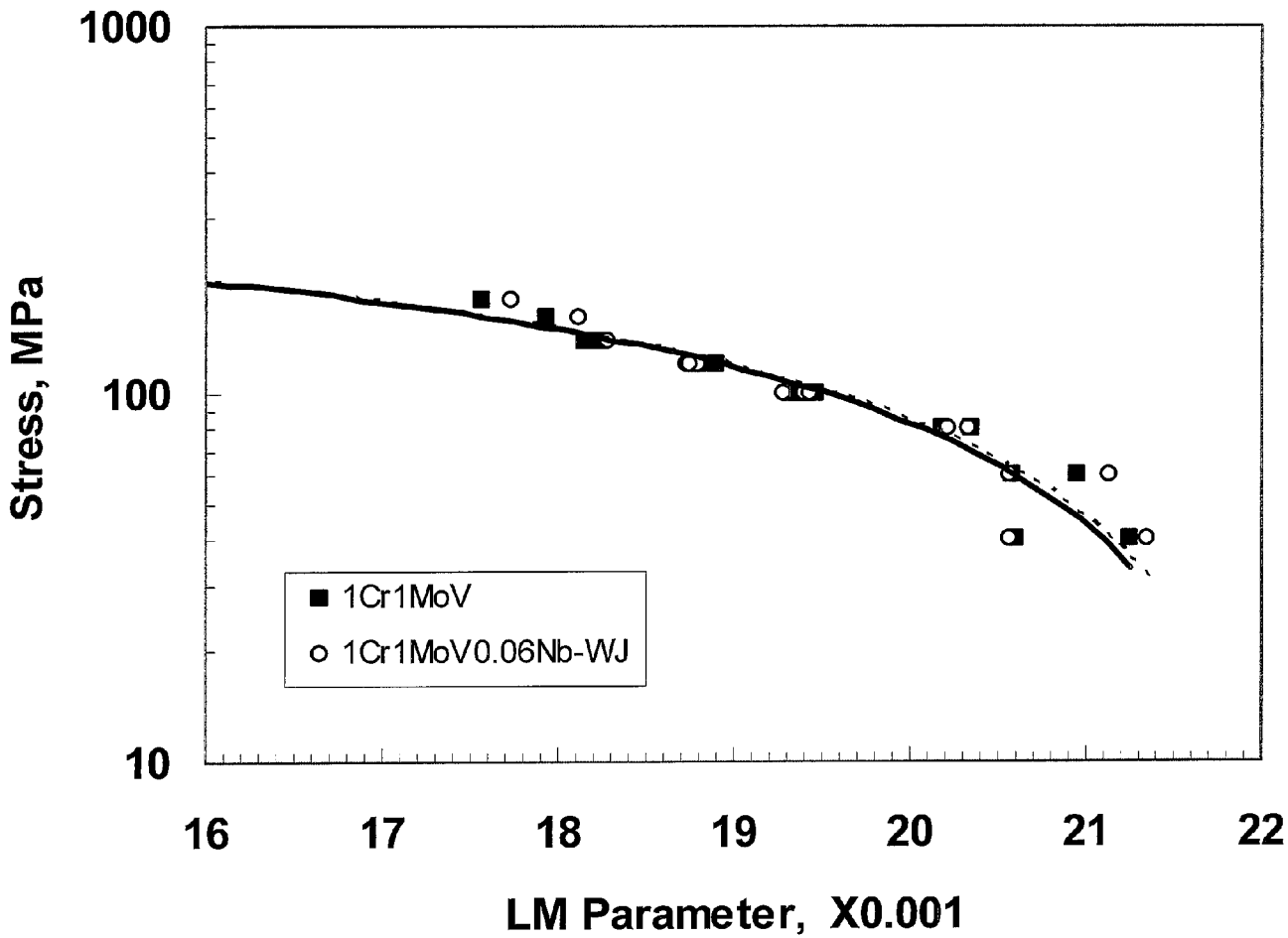
Figure 4C:
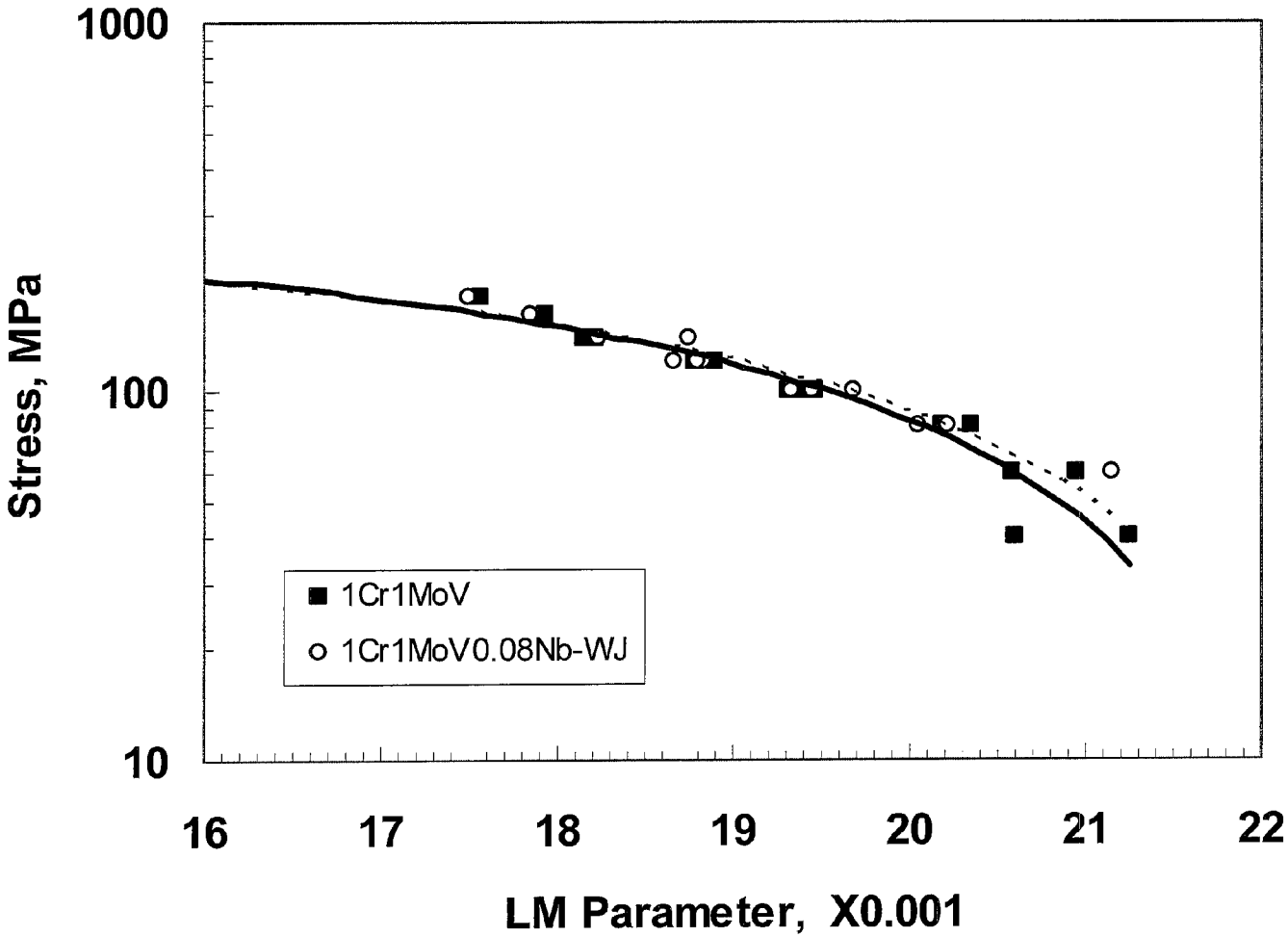
Figure 5:
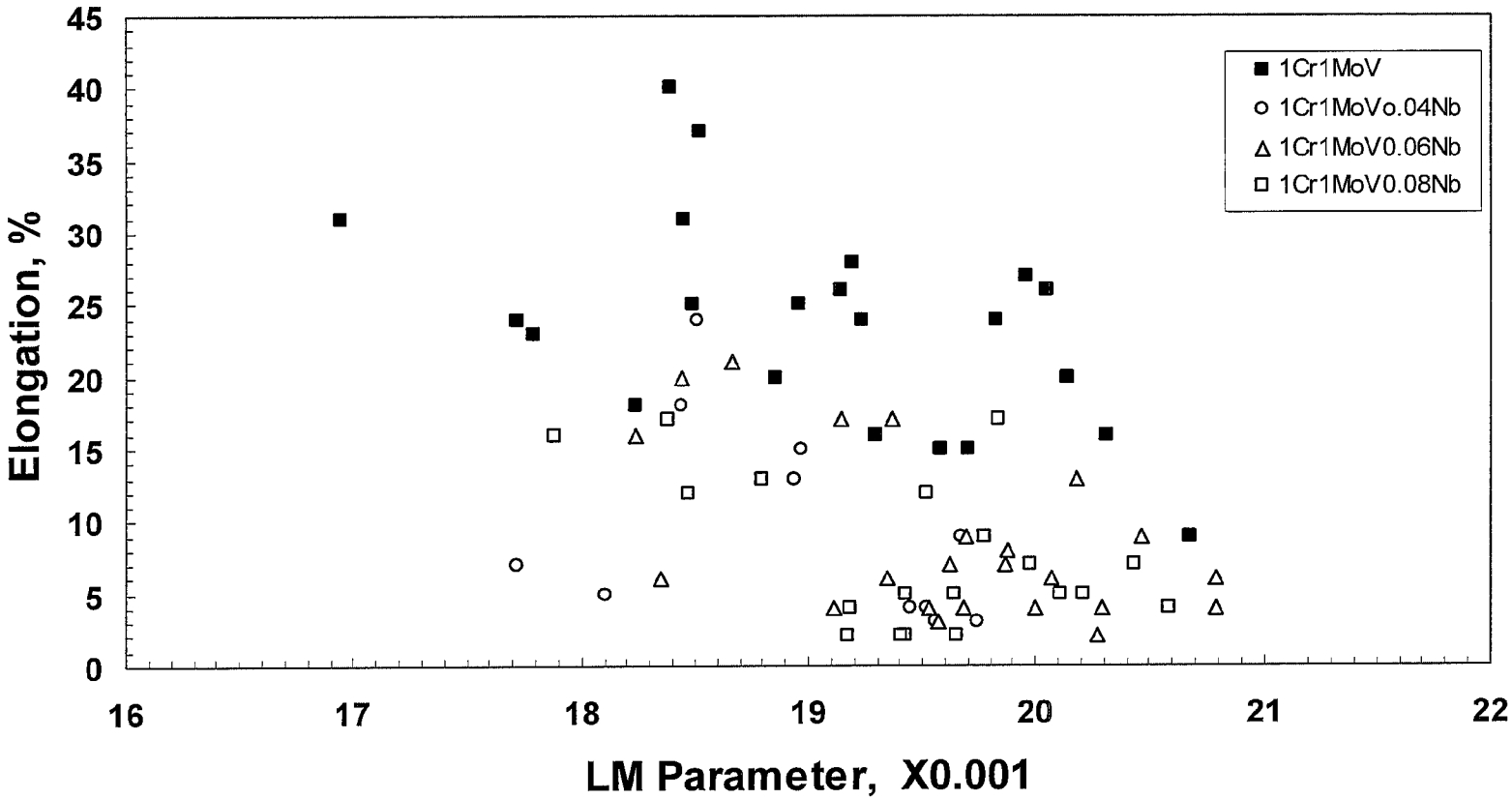
FIG. 5 is a graphical representation of Larson Miller Parameter vs. elongation plots for 1Cr1Mo¼V steel with different Nb contents.
Figure 6:
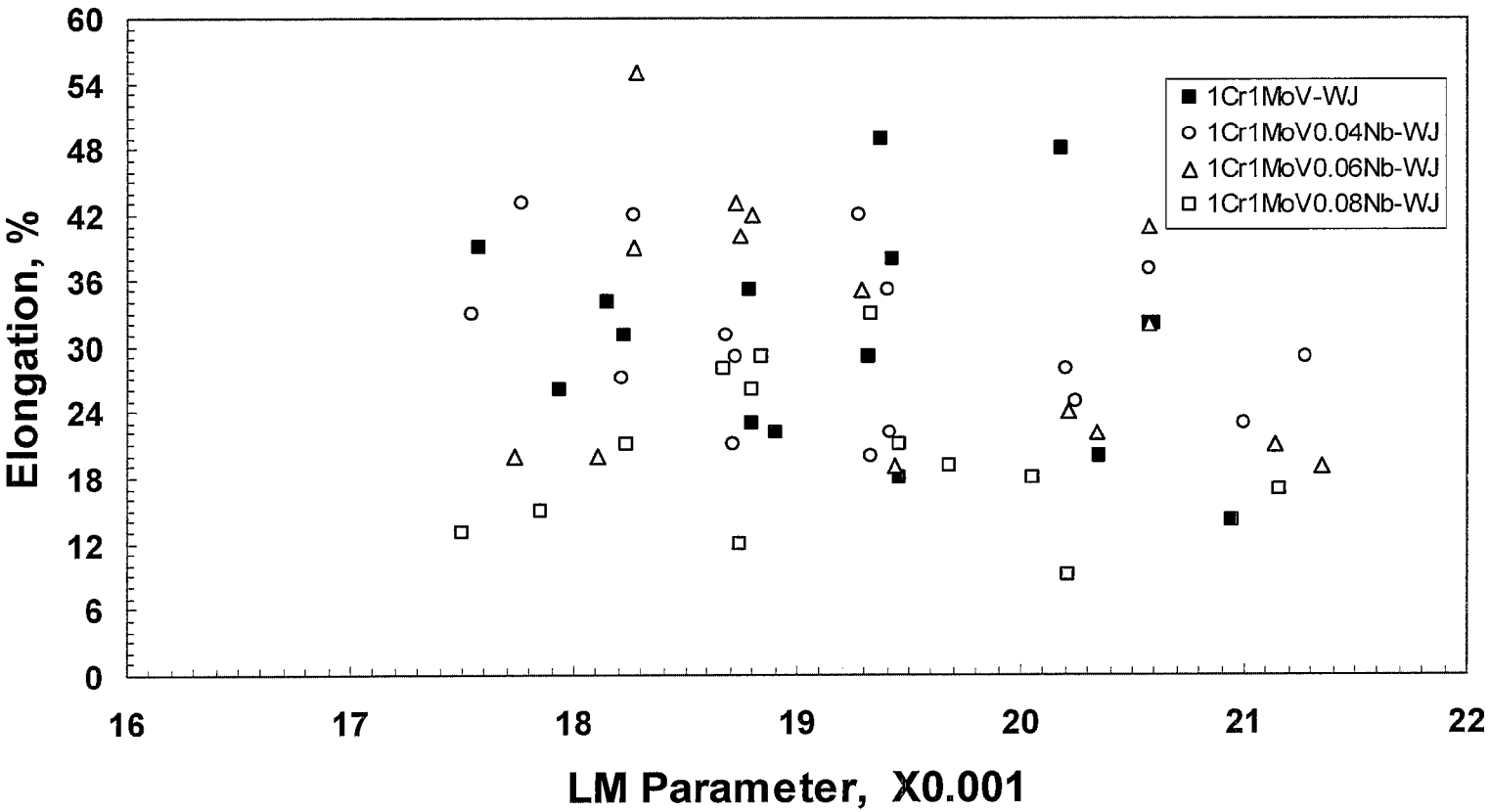
FIG. 6 is a graphical representation of Larson Miller Parameter vs. elongation plots for 1Cr1Mo¼V steel weld joints with different Nb.
Figure 7:
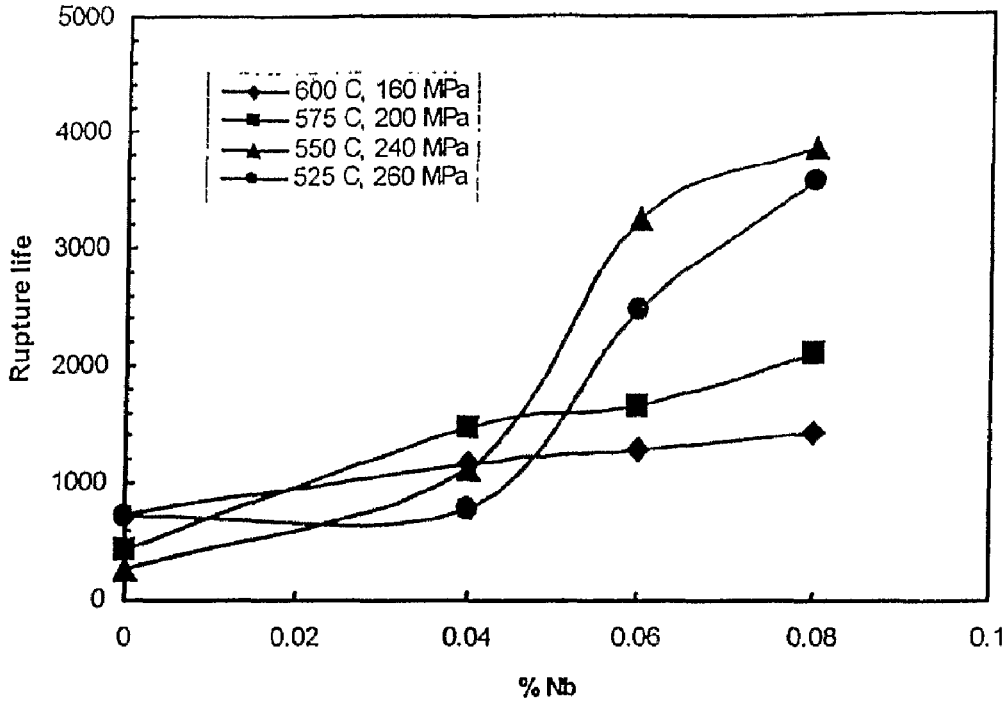
FIG. 7 is a graphical representation of the effect of Nb content on creep-rupture properties of 1Cr1Mo¼V steel tested at different test conditions.
Figure 8:
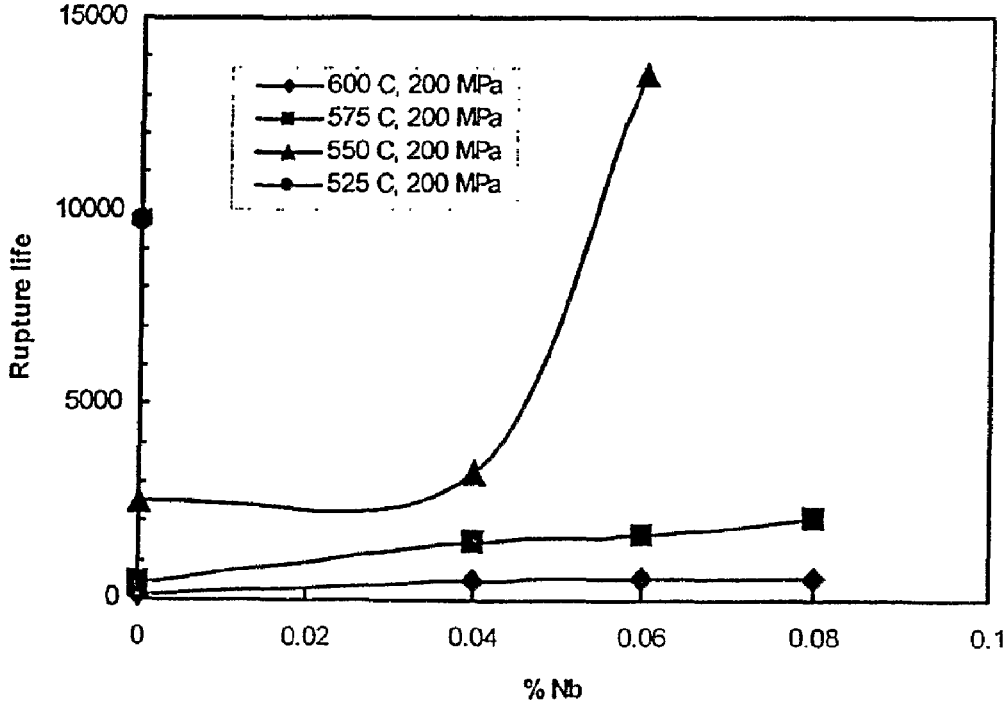
FIG. 8 is a graphical representation of the effect of Nb content on creep-rupture properties of 1Cr1Mo¼V steel tested at 200 Mpa at different test temperatures.

1Cr1Mo¼V castings with 0.06% and 0.08% Nb exhibit higher creep rupture properties (FIGS. 3A-3C). The creep ductility of these casts is slightly lower than plain 1Cr1Mo¼V steel.

On the basis of creep-rupture test results on weld joint samples, the weld joints of steel with 0.06% Nb are found to be stronger than plain 1Cr1Mo¼V steel as well as with 0.04 and 0.08% Nb (Tables 3 & 4 & FIGS. 3A to 8)

TABLE 3

| Room temperature tensile strength of Cr-Mo-V steel castings | | | | | |
|---|---|---|---|---|---|
| Condition | UTS | YS | % EL | % RA | Remarks |
| Longitudinal direction | | | | | |
| Cast A | 62.79 | 42.70 | 20.80 | 58.19 | |
| Without Nb | 64.18 | 45.00 | 22.28 | 67.06 | |
| Cast B | 72.30 | 60.00 | 19.88 | 63.18 | |
| | 73.36 | 60 | 19.08 | 62.12 | |
| Cast C | 73.29 | 61.14 | 19.02 | 58.79 | |
| | 74.47 | 61.79 | 18.00 | 59.68 | |
| Cast D | 73.92 | 62.50 | 18.74 | 63.81 | |
| | 72.62 | 61.10 | 16.45 | 65.51 | |
| Transverse direction | | | | | |
| Cast A | 64.95 | 45.9 | 24.11 | 65.70 | |
| Cast B | 72.15 | 60.10 | 17.14 | 60.38 | |
| Cast C | 73.19 | 60.7 | 18.57 | 60.38 | |
| Cast D | 73.52 | 62.10 | 17.14 | 60.48 | |

TABLE 4

| Impact strength of Cr-Mo-V steels | | | | |
|---|---|---|---|---|
| Impact strength of base metal in longitudinal direction, J | | | | |
| Cast A | 20J | 16J | 32J | 43J |
| Cast B | 27J | 23J | 51J | 28J |
| Cast C | 39J | 21J | 50J | 26J |
| Cast D | 54J | 62J | 35J | 30J |
| Impact strength of base metal in transverse direction, J | | | | |
| Cast A | 43J | 40J | 36J | |
| Cast B | 24J | 22J | 20J | |
| Cast C | 25J | 32J | 35J | |
| Cast D | 24J | 35J | 31J | |
| Impact strength of the weld joint, J | | | | |
| Cast A | AW1-50J | AW2-48J | AW4-56J | |
| Cast B | BW1-36J | BW2-45J | BW4-34J | |
| Cast C | CW3-34J | CW4-33J | CW5-29J | |
| Cast D | DW1-29J | DW3-36J | DW5-36J | |
| Impact strength of the HAZ, J | | | | |
| Cast A | AH1-85J | AH2-66J | AH5-91J | |
| Cast B | BH3-44J | BH4-76J | BH5-42J | |
| Cast C | CH2-22J | CH4-36J | CH5-41J | |
| Cast D | DH1-54J | DH3-73J | DH4-65J | |

The castings with Nb content exhibit excellent mechanical and creep properties at high temperature. If a turbine casing is made of steels having the specified range of Nb, it is possible to increase the steam temperature and pressure. The weldability of the steel also increases, which will help in repair jobs.

We claim:

1. A chromium-molybdenum-vanadium (Cr—Mo—V) cast steel comprising carbon in 0.08 to 0.12% by weight, sulphur in 0.015% by weight or less, phosphorous in 0.02% by weight or less, silicon in 0.30 to 0.60% by weight, manganese in 0.50 to 0.80% by weight, chromium in 1.20 to 1.50% by weight, molybdenum in 0.90 to 1.10% by weight, vanadium in 0.20 to 0.30% by weight, 0.06 to 0.08% by weight of niobium, and the balance iron and inevitable impurities;

wherein the cast steel exhibits high creep rupture properties as defined by the Larson Miller Parameter vs. stress plots in FIGS. 3B and 3C.

2. A turbine casing comprising the steel of claim 1.

3. A valve casing comprising the steel of claim 1.

* * * * *